US006000521A

United States Patent [19]

Jung

[11] Patent Number: 6,000,521

[45] Date of Patent: Dec. 14, 1999

[54] SLIDABLE DOOR FOR A BILL INLET

[75] Inventor: Il-Du Jung, Kwangju, Rep. of Korea

[73] Assignee: Kwangju Electronics Co., Ltd., Kwangju, Rep. of Korea

[21] Appl. No.: 09/065,631

[22] Filed: Apr. 24, 1998

[30] Foreign Application Priority Data

May 1, 1997 [KR] Rep. of Korea ..... 97-16930

[51] Int. Cl.[6] ..... G07F 7/04; E06B 3/34

[52] U.S. Cl. ..... 194/206; 194/351; 49/40; 49/41

[58] Field of Search ..... 194/206, 207, 194/351; 109/11, 16, 49.5; 49/40, 41

[56] References Cited

U.S. PATENT DOCUMENTS

| | | | |
|---|---|---|---|
| 4,355,711 | 10/1982 | Hirose | 194/206 |
| 4,479,049 | 10/1984 | Hirose | 194/206 |
| 5,172,643 | 12/1992 | Koshida et al. | 49/40 |
| 5,195,739 | 3/1993 | Watabe | 194/206 |

FOREIGN PATENT DOCUMENTS

| | | | |
|---|---|---|---|
| 2-14395 | 1/1990 | Japan | 194/351 |

*Primary Examiner*—Robert P. Olszewski
*Assistant Examiner*—Bryan Jaketic
*Attorney, Agent, or Firm*—Perman & Green, LLP

[57] ABSTRACT

An automatic vending machine having a bill input inlet disposed at a predetermined position of a front cabinet, a bill discriminating apparatus embedded inside of the front cabinet at an identical height level to the bill input inlet for discriminating the authenticity of a bill induced through the bill input inlet and for storing the bill, wherein the bill input inlet is constructed of an opening and closing structure, the inlet comprising: a door inducing member installed between upper side of the bill input inlet and the bill discriminating apparatus being connected to the front; a bill input inlet door disposed to slide toward the door inducing member; and a door control unit for opening the bill input inlet door by being hitched and stopped with the stopping pin for a predetermined time duration after the door is pushed up open and released and for closing the door as it falls down by its weight with the stopping pin being raised, thereby conveniently inserting a bill only by using one hand of a customer.

4 Claims, 1 Drawing Sheet

SLIDABLE DOOR FOR A BILL INLET

BACKGROUND OF THE INVENTION

1. Field of the Invention

The present invention relates to an automatic vending machine and more particularly to an opening and closing structure of a bill input inlet thereof to get a bill conveniently inserted only by using one hand of a customer as a bill input inlet door is opened, hitched and maintained by a stopping pin of door control means for a certain time duration and the stopping pin is raised to let the door drop by its weight.

2. Description of the Prior Art

In general, an opening and closing structure of a bill input inlet of an automatic canned product vending machine, as shown in FIG. 1, includes a bill input inlet(11) disposed at a predetermined position of the front cabinet(10), a bill discriminating apparatus(30) embedded inside of the front cabinet(10) at a same height level for discriminating the authenticity of a bill induced through the bill input inlet(11) and for storing the bill and a movable bill input inlet door(20) hinged at the upper side of the bill input inlet(11) for opening and closing the bill input inlet(11).

The bill discriminating apparatus(30) includes a bill guiding groove(31) disposed at an identical height with the bill input inlet(11) for getting a bill(a) conveniently drawn-in, and a bill inducing inlet(32) connected to a bill guiding area(31) for getting a bill(a) rolled in.

Therefore, in order to get the bill input through the bill inducing inlet(32) of the bill discriminating apparatus(30), the bill is flattened and drawn into the bill inducing inlet(32) through the bill guiding area(31) after the bill input inlet door(20) is swung up open.

However, in case one hand of a customer is occupied with an umbrella or other parcels, it is difficult to flatten a bill and to insert a bill through the bill input inlet(11) and the bill guiding area(31) to the bill inducing inlet(32) with the bill input inlet door(20) lifted open.

SUMMARY OF THE INVENTION

The present invention is presented to solve the aforementioned problems and it is an object of the present invention to provide an opening and closing structure of a bill input inlet of an automatic vending machine where, after a bill input inlet door is lifted up to a door inducing member, the bill input inlet door is hitched and momentarily stopped by a stopping pin of door control means, and is closed by its falling weight as the stopping pin is raised in a certain time duration, thereby making it easy to conveniently insert the bill.

In order to achieve the object of the present invention, there is provided an automatic vending machine having a bill input inlet disposed at a predetermined position of a front cabinet, a bill discriminating apparatus embedded inside of the front cabinet at an identical height level to the bill input inlet for discriminating the authenticity of a bill induced through the bill input inlet and for storing the bill and a movable bill input inlet door hinged at the upper side of the bill input inlet for opening and closing the bill input inlet, wherein the bill input inlet is constructed of an opening and closing structure comprising:

a door inducing member installed between upper side of the bill input inlet and the bill discriminating apparatus being connected to the front;

a bill input inlet door disposed to slide toward the door inducing member; and door control means for opening the bill input inlet door by being hitched and stopped with the stopping pin for a predetermined time duration and for closing the door as it falls down by its weight with the stopping pin being raised

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
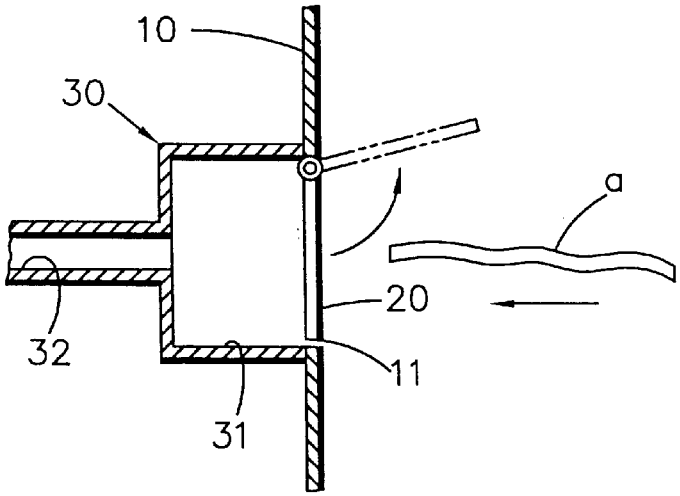
FIG. 1 (PRIOR ART)
FIG. 1 is a brief sectional view for illustrating an opening and closing structure of a bill input inlet of a conventional automatic vending machine.
Figure 2:
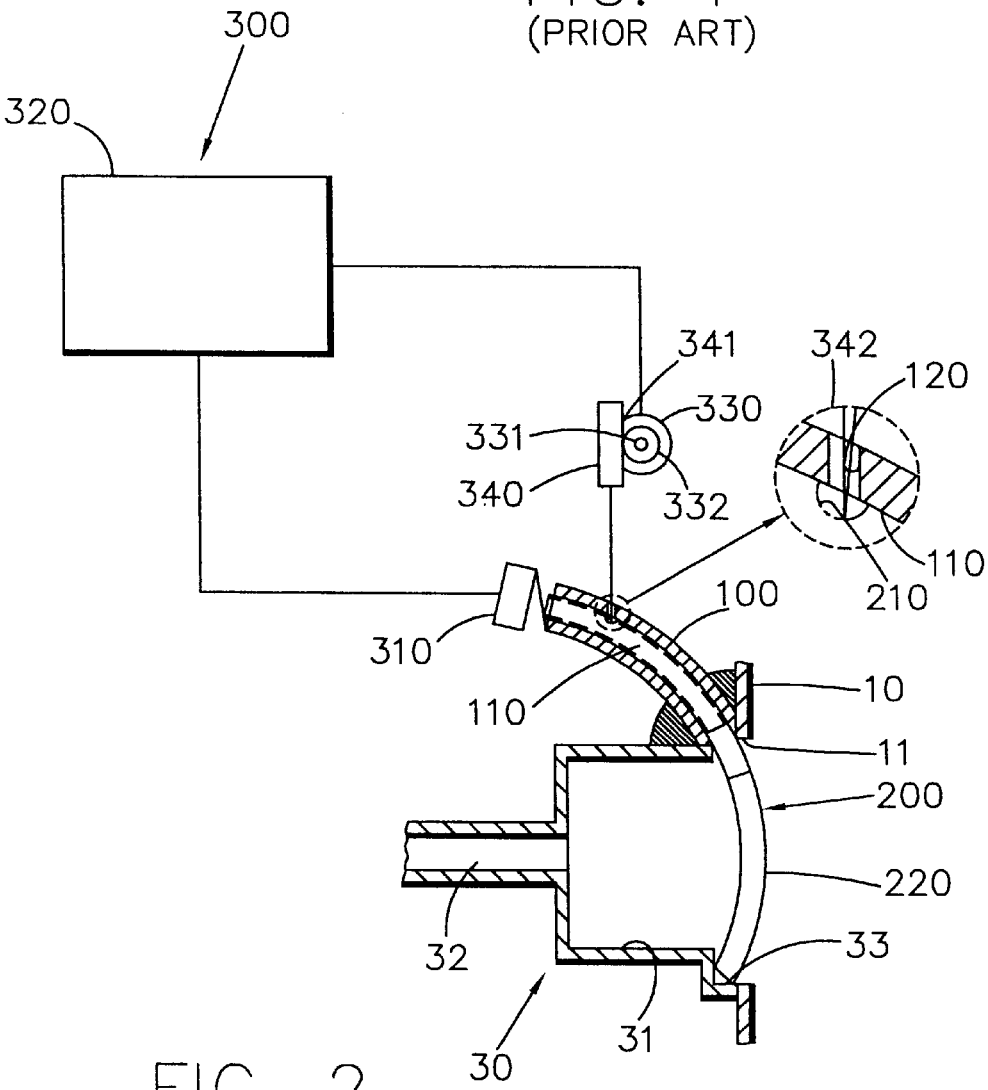
FIG. 2 is a brief sectional view including a detailed partial view for illustrating an opening and closing structure of a bill input inlet of an automatic vending machine in accordance with the present invention.

An embodiment of the present invention is described in detail with reference to the accompanying drawings. In FIG. 2, like reference numerals and symbols are used for designation of like or equivalent parts or portions in FIG. 1 for simplicity of illustration and explanation, and redundant references will be omitted.

The opening and closing structure of a bill input inlet of an automatic canned product vending machine in accordance with the present invention, comprises a bill input inlet(11) disposed at a predetermined position of a front cabinet(10), a bill discriminating apparatus(30) embedded inside of the front cabinet(10) at a same height level to the bill input inlet(11) for discriminating the authenticity of a bill induced through the bill input inlet(11) and for storing the bill and a movable bill input inlet door(200) hinged at the upper side of the bill input inlet(11) for opening and closing the bill input inlet(11), wherein the bill input inlet is constructed of an opening and closing structure where, after a bill input inlet door is lifted up to a door inducing member, the bill input inlet door is hitched and momentarily stopped by a stopping pin of door control means, and is closed by its falling weight as the stopping pin is raised in a certain time duration, thereby making it easy to conveniently insert the bill.

The door inducing member(100) comprises a door inducing inlet(110) formed in a pipe correspondingly to the curve of the bill input inlet door(200) being connected open to the front with the ends thereof fixed at the upper sides of the bill input inlet(11) and the bill discriminating apparatus(30) and a stopping pin moving hole(120) to enable the stopping pin(342) to penetrate through.

The bill input inlet door(200) comprises a plastic door plate(220) with a stopping pin accommodating portion(210) formed for causing the stopping pin(342) to be lowered and compressed under a predetermined pressure.

The door control means(300) comprises a micro-switch (310) installed behind the door input inlet(110) to be turned on as the bill input inlet door(200) is pushed in and compressed in more than a predetermined pressure, a programmable logic controller (PLC) board to get the ON signal of the micro-switch(310) and to determine a waiting time duration, rotating direction and frequency of a motor(330), a motor(330) to be rotated by the signal from the PLC board(320), a pinion(332) installed at one end of a rotating shaft(331) of the motor(330) and a door control member (340) having a vertically movable prominence part(341) to be met with the pinion(332) and a stopping pin(342) to be moved through the stopping pin moving hole(120) as it is lowered and to compress the stopping pin accommodating portion(210) in a predetermined pressure.

Next, operational effect of the present invention is described in detail. In order to get the bill(a) inserted into the bill inducing inlet(32) of the bill discriminating apparatus (30), the bill input inlet door(200) is lifted up open to the end, the rear part of the bill input inlet door(200) turns on the micro-switch(310) of the door control means(300) and the ON signal of the micro-switch(310) is sent to the PLC board(320).

The PLC board(320) sends a signal input with a waiting time duration, and rotation direction and frequency to the motor(330) which is rotated by the signal to get the door control member(340), whereby an end of the stopping pin(342) puts a predetermined pressure on the stopping accommodating portion(210)of the bill input inlet door (200).

Therefore, the door control member(340) is stopped for a time according to the data input at the PLC board(320). At this time, the bill (a) is inserted through the bill inducing inlet(32).

The door input inlet door(200) is lifted up open to the door inducing inlet(110) of the door inducing member(100) and released, the door input inlet door(200) is hitched and stopped by the stopping pin(342) of the door control means (300) for a predetermined time duration, and then the bill input inlet door(200) falls down by its weight as stopping pin(342) is raised.

There is an advantage of the present invention in that a bill input inlet of an automatic vending machine is constructed with an opening and closing structure where, after the bill input inlet door is pushed up to the door inducing member (100), a bill input inlet door is hitched and stopped by the stopping pin(342) for a predetermined time duration and then the door falls down by its weight as the stopping pin(342) is raised, thereby getting a bill conveniently inserted only by using one hand of a customer.

Even if the embodiment of the present invention is described here, the actual scope of the present invention is not limited in the presented embodiment. It is believed evident that many variations be made by those skilled in the art without departing from the spirit and scope of this invention.

What is claimed is:

1. An automatic vending machine having a bill input inlet disposed at a predetermined position of a front cabinet, a bill discriminating apparatus embedded inside of the front cabinet at an identical height level to the bill input inlet for discriminating the authenticity of a bill induced through the bill input inlet and for storing the bill, wherein the bill input inlet is constructed of an opening and closing structure comprising:

a door inducing member installed between upper side of the bill input inlet and the bill discriminating apparatus being connected to the front;

a bill input inlet door disposed to slide toward the door inducing member; and door control means for opening the bill input inlet door by being hitched and stopped with a stopping pin for a predetermined time duration and for closing the door as it falls down by its weight with the stopping pin being raised.

2. The machine, as defined in claim 1, wherein the door inducing member comprises:

a door inducing inlet formed in a pipe correspondingly to a curve of the bill input inlet door being connected open to the front with the ends thereof fixed at the upper sides of the bill input inlet and the bill discriminating apparatus; and a stopping pin moving hole to enable the stopping pin to be inserted therein.

3. The machine, as defined in claim 1, wherein the bill input inlet door comprises a plastic door plate with a stopping pin accommodating portion formed for causing the stopping pin to be lowered and compressed under a predetermined pressure.

4. The machine, as defined in claim 1, wherein the door control means comprises:

a micro-switch installed behind the door input inlet to be turned on as the bill input inlet door is pushed in and compressed in more than a predetermined pressure;

a programmable logic controller board to get an ON signal of the micro-switch and to determine a waiting time duration, rotating direction and frequency of a motor;

a motor to be rotated by a signal from the programmable logic controller board, a pinion installed at one end of a rotating shaft of the motor; and a door control member having a vertically movable prominence part to be met with the pinion and a stopping pin to be moved through the stopping pin moving hole as it is lowered and to compress the stopping pin accommodating portion in a predetermined pressure.

* * * * *